US010751557B2

(12) United States Patent
Ozment

(10) Patent No.: US 10,751,557 B2
(45) Date of Patent: Aug. 25, 2020

(54) METHOD FOR SUPPRESSING AND EXTINGUISHING A COAL SEAM FIRE

(71) Applicant: Alden Ozment, Longview, TX (US)

(72) Inventor: Alden Ozment, Longview, TX (US)

( * ) Notice: Subject to any disclaimer, the term of this patent is extended or adjusted under 35 U.S.C. 154(b) by 114 days.

(21) Appl. No.: 15/998,382

(22) Filed: Aug. 13, 2018

(65) Prior Publication Data

US 2019/0054331 A1 Feb. 21, 2019

Related U.S. Application Data

(60) Provisional application No. 62/605,579, filed on Aug. 18, 2017.

(51) Int. Cl.

| | |
|---|---|
| ***A62C 3/02*** | (2006.01) |
| ***E21B 7/04*** | (2006.01) |
| ***E21B 33/13*** | (2006.01) |
| ***E21F 5/02*** | (2006.01) |
| ***A62C 99/00*** | (2010.01) |
| *A62C 3/06* | (2006.01) |
| *A62C 31/22* | (2006.01) |

(52) U.S. Cl.

CPC ..... *A62C 3/0292* (2013.01); *A62C 3/0271* (2013.01); *A62C 99/0036* (2013.01); *E21B 7/04* (2013.01); *E21B 33/13* (2013.01); *E21F 5/02* (2013.01); *A62C 3/06* (2013.01); *A62C 31/22* (2013.01)

(58) Field of Classification Search

CPC ..... A62C 2/00; A62C 3/0292; A62C 3/0271; A62C 99/0036; E21B 7/04; E21B 33/13

See application file for complete search history.

(56) References Cited

U.S. PATENT DOCUMENTS

| | | | | |
|---|---|---|---|---|
| 3,648,614 | A * | 3/1972 | Berthmann | F42D 1/26 102/313 |
| 4,484,629 | A | 11/1984 | Terry | |
| 7,096,965 | B2 | 8/2006 | Ozment | |
| 7,104,336 | B2 | 9/2006 | Ozment | |
| 7,334,644 | B1 | 2/2008 | Ozment | |
| 7,464,992 | B1 | 12/2008 | Ozment | |
| 2005/0011653 | A1 | 1/2005 | Strabala | |
| 2012/0018151 | A1* | 1/2012 | Ide | E21B 43/166 166/251.1 |
| 2013/0299202 | A1* | 11/2013 | Sinunu | A62D 1/0035 169/46 |
| 2017/0268338 | A1* | 9/2017 | Qin | E21F 5/00 |

* cited by examiner

*Primary Examiner* — Tuongminh N Pham
(74) *Attorney, Agent, or Firm* — Randal Homburg

(57) ABSTRACT

A method for the suppression of coal seam fires provides for the location and determination of the boundaries of a coal seam fire, directing access to the coal seam, preparation of the coal seam prior to suppression and the suppression of the fire within the coal seam using a foam mixture, the method providing minimal impact and disruption to the surface above the coal seam fire.

3 Claims, 6 Drawing Sheets

METHOD FOR SUPPRESSING AND EXTINGUISHING A COAL SEAM FIRE

CROSS REFERENCE TO RELATED APPLICATIONS

Applicant claims the benefit of Provisional Patent Application No. 62/605,579, filed on Aug. 18, 2017, by the same inventor.

I. BACKGROUND OF INVENTION

1. Field of the Invention

An improved method and process for the suppression of coal seam fires provides for the location and determination of the boundaries of a coal seam fire, gaining access to the coal seam through directional boring of multiple access bores above, below and completely surrounding the coal seam fire, preparation of the coal seam prior to suppression, injection of a soap, water and inert gas mixture to wet and cool the coal seam contemporaneously from the multiple access bores, suppressing and extinguishing the coal seam fire, and restoration of the surface above and around the coal seam fire with minimized disruption and damage to the environment.

2. Description of Prior Art

A preliminary review of prior art patents was conducted by the applicant which reveal prior art patents in a similar field or having similar use. However, the prior art inventions do not disclose the same or similar elements as the present method for suppression and extinguishment of a coal seam fire, nor do they present the material components in a manner contemplated or anticipated in the prior art.

In a prior patent application, U.S. Patent Application No. 2005/0011653 to Strabala, a method is disclosed for the surface extinguishment of an underground coal seam fire using the steps of providing a quantity of a carbon dioxide generating material in a form suitable for injecting into the ground, determining a location above or adjacent to an underground fir, drilling one or more suitable injection sites at the desired locations and injecting the carbon dioxide generating materials into the ground, using the heat from the fire to produce carbon dioxide gas to extinguish or reduce the fire. Additional steps include use of a plurality of injection sites, powdered limestone and water or within a slurry being used as the carbon dioxide containing material, drilling the injection sites at the leading edge of the fire only, use of aerial infra-red technology or assaying drilling samples to determine the identity and location of the injection sites, and use of additional extinguishing methods in conjunction with the carbon dioxide material injections.

In U.S. Pat. No. 4,484,629 to Terry, a method for gasifying coal to enhance the production of gasified coal subsequent to intentional ignition of the coal seam. This appears to be a patent that intentionally ignites a coal seam instead of deal with its extinguishment or suppression, but does involve some injection of an oxidizer as well, which is the opposite material used for injection in the present method, using instead, an anti-oxidizer. In the present patent, the anti-oxidizer is a generated foam using an inert gas, such as nitrogen.

II. SUMMARY OF THE INVENTION

Coal seam fires are subsurface fires in a coal deposit. They are most commonly ignited by natural phenomena, including lightning a heat and pressure from subsurface stress, or by human and/or natural sources including forest fires, grass fires or explosions. They are particularly difficult to extinguish because they continue to smolder underground from several days to several years before flare up and restarting forest and brush fires nearby. They propagate in a creeping fashion along manmade shafts and cracks in geological layers.

According to the Office of Surface Mining Reclamation and Enforcement Abandoned Mine Land Inventory System, in 2013 the were 98 underground mine fires burning in 9 states. This is considered by experts to be an underestimate for the actual number of fires nationwide. Abandoned mine fires, if left uncontrolled, can burn for years and, in fact, one of the most well known mine fires in the CS, in Centralia, Pa., has been burning for 55 years, first detected in 1962. In Centralia, the mine fire won the battle, despite suppression and control efforts, as most of the residents were bought out by the Common wealth and moved away. The world record for the longest burning coal fire, which may have started around 5000 years ago, in New South Wales, Australia, is still smoldering.

Suppression of coal mine fires requires cooling the hot zones and removing any source of oxygen. If the workings are shallow, the fire zones can be unearthed and the burning mass can be quenched on the surface, If the workings are too deep to excavate, then the fire must be suppressed remotely through boreholes using a variety of agents including water, gas-enhanced foam and grout. Access to surface areas for drilling can be problematic due to topographical and property constraints. When this occurs, large areas of burning may go unaddressed or simply left to burn.

The present invention deals with us of gas foam plus enhanced drilling technology. Gas-enhanced foam has the advantage of using less water and adds inert nitrogen gas to displace oxygen to infiltrate and suppress fire. Directional drilling has to capability to steer a borehole to a specific place underground. Directional drilling has many advantages over conventional drilling technology as it provides the least disruption too the ground surface, minimizes surface preparation and reclamation costs, multiple targets can be reached from a single drill site and injection of the gas foam in numerous location at the same time. It is also not constrained by terrain.

Coal fires cause serious health and safety hazards by the release of toxic and suffocating gases and fumes, burning land and forest, homes, roads, pipelines, bridges, commercial buildings, electric lines, and other manmade combustible structures. These fires, without extinguishment, can burn for decades until their fuel source is fully consumed. They have historically been extremely difficult and costly to extinguish, and not without significant damage to the surface, and are unlikely to be extinguished by natural means, including rain. See, Whitehouse, Alfred, et al. (2004) "Coal Fires in Indonesia". *International Journal of Coal Geology* (Amsterdam: Elsevier) 2012 (1-2_: 91-97 [p. 95].doi: 10.1016/j.coal.2003.08.010. ISSN 0166-5162. Global coal fires are estimate to cause 40 tons of mercury to enter the atmosphere annually and to represent 3% of the worlds annual $CO_2$ emissions. See, Dan Cray (Jul. 23, 2010). "Deep Underground, Miles of Hidden Wildfires Rage". *Time Magazine*.

Ignition can be spontaneous and can often self-ignite at temperatures as low a 40° C. for brown coal in the right conditions of moisture and gram size. Krajick, Kevin (2005 May 1). Fire in the Hole". *Smithsonian Magazine*. Pp 54ff.Retrieved 2007 Jan. 16. Wildfires can ignite the coal closer to the surface or entrance of a shaft, and the smoldering fire can spread through the seam, creating subsidence that may open further seams to oxygen and spawn future wildfires when the fire breaks to the surface.

It is known in the art of coal fire suppression that it is most desired to locate the underground extent as precisely as possible before attempting to extinguish the coal seam fire. These include:

a) measuring surface temperatures, fissures and boreholes;
b) gas measurements to characterize the fire ventilation system in a mine fire, as well as the gas composition, so that the combustion reactions can be diagnosed;
c) geophysical measurement of the ground and from aerial means, including determination of humidity near the fire, magnetism readings, or other observable changes in the immediate land formations; and
d) remote sensing from aircraft and satellites using high optical and thermal imaging.

Techniques used to extinguish these coal seam fires are few, based on a search of the prior art. Most commonly, energy is removed from the coal seam fire by injecting large amounts of liquid, primarily water. Additives are known to be mixed with water. In coal mine fires, it is known by the inventor that mixing nitrogen gas with water and soap to create a flooding and suffocating foam can be used, after construction of a barrier or dam in the mine, using existing pipelines or direct flood injections. See U.S. Pat. Nos. 7,464,992, 7,334,644, 7,104,336, and 7,096,965—all to Alden Ozment, the same inventor of the present patent method and process.

However, coal seam fires are different, in that they are no open shafts. Coal seam fires require intentional access to the coal seam and its boundaries, with a focus on creating as little damage to the ground surface as possible. By using advanced drilling techniques developed by non-conventional oil and gas drilling, called directional boring, we can now penetrate coal seams from nearly any collateral location—no longer confined to vertical drilling. Access can be gained above, below and around a coal seam fire, with several bores capable of being drilled from a single drill location. As the bores are gained, each bore is cleared to create an unimpeded flow path between the well bore and the coal formation.

In this regard, the objective of the present method and process requires the steps of determining the boundaries of a coal seam fire using a series of vertical bore holes to measure the depth and temperature of the coal seam fire within each bore hole until a non-combustion temperature (hereinafter a "normal" temperature) is obtained, marking each borehole with that normal temperature as a boundary borehole, until the entire perimeter of the coal seam fire is established, determining the least surface damaging location from which to drill direction bores into the coal seam using a minimal amount of drill entry locations surrounding the coal seam fire, drilling the directional bores into the coal seam fire, injecting under pressure a mixture 50 of water, soap and inert gas, preferably nitrogen, into each directional bore from a plurality of the directional bore holes contemporaneously from the perimeter to the inner portion of the coal seam until the coal seam fire is extinguished, verifying the coal seam after suppression of a return to a normal temperature by vertical bore measurement of the coal seam fire at a plurality of locations within the outer perimeter, and restoring the ground surface to a pre-method state, or at least restoring the ground surface to a least disruptive state. Other additional method steps may be employed depending on the type of coal within the coal seam, the environment above the coal seam, the density of the coal seam, the depth of the coal seam and the geological structures above and below the coal seam which may be affected by the suppression and extinguishment of the coal seam fire.

III. DESCRIPTION OF THE DRAWINGS

The following illustrations and drawings are included and attached to this application. These drawings descriptions are as indicated below:

FIG. 6 is an illustration showing the surface restorative procedures upon complete extinguishment of the coal seam fire.

IV. DESCRIPTION OF THE PREFERRED EMBODIMENT

Figure 1:
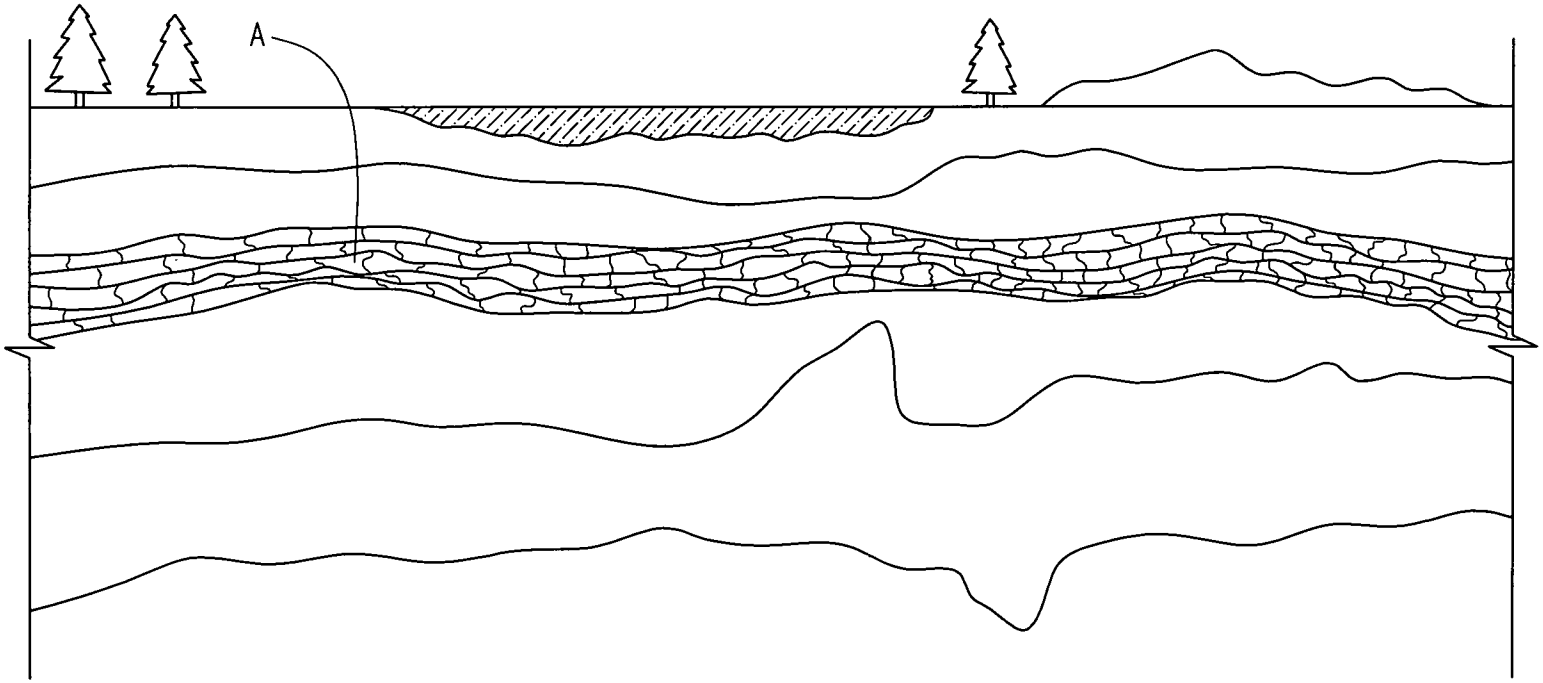
FIG. 1 is a cross sectional perspective view of an underground coal seam.
Figure 2:
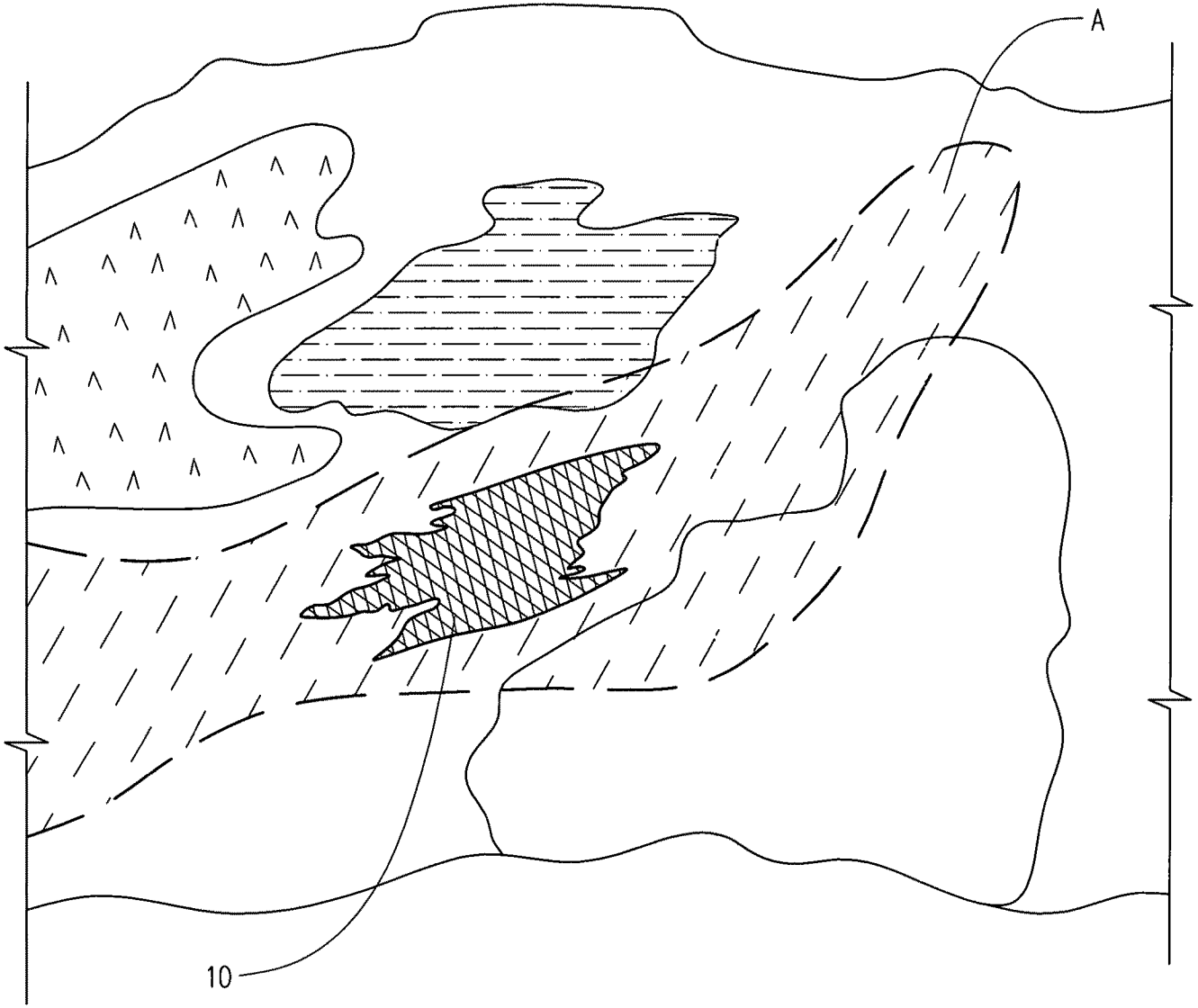
FIG. 2 is a topical surface representation of the area above the coal seam indicating preferred drill site for conducting the boring.
Figure 3:
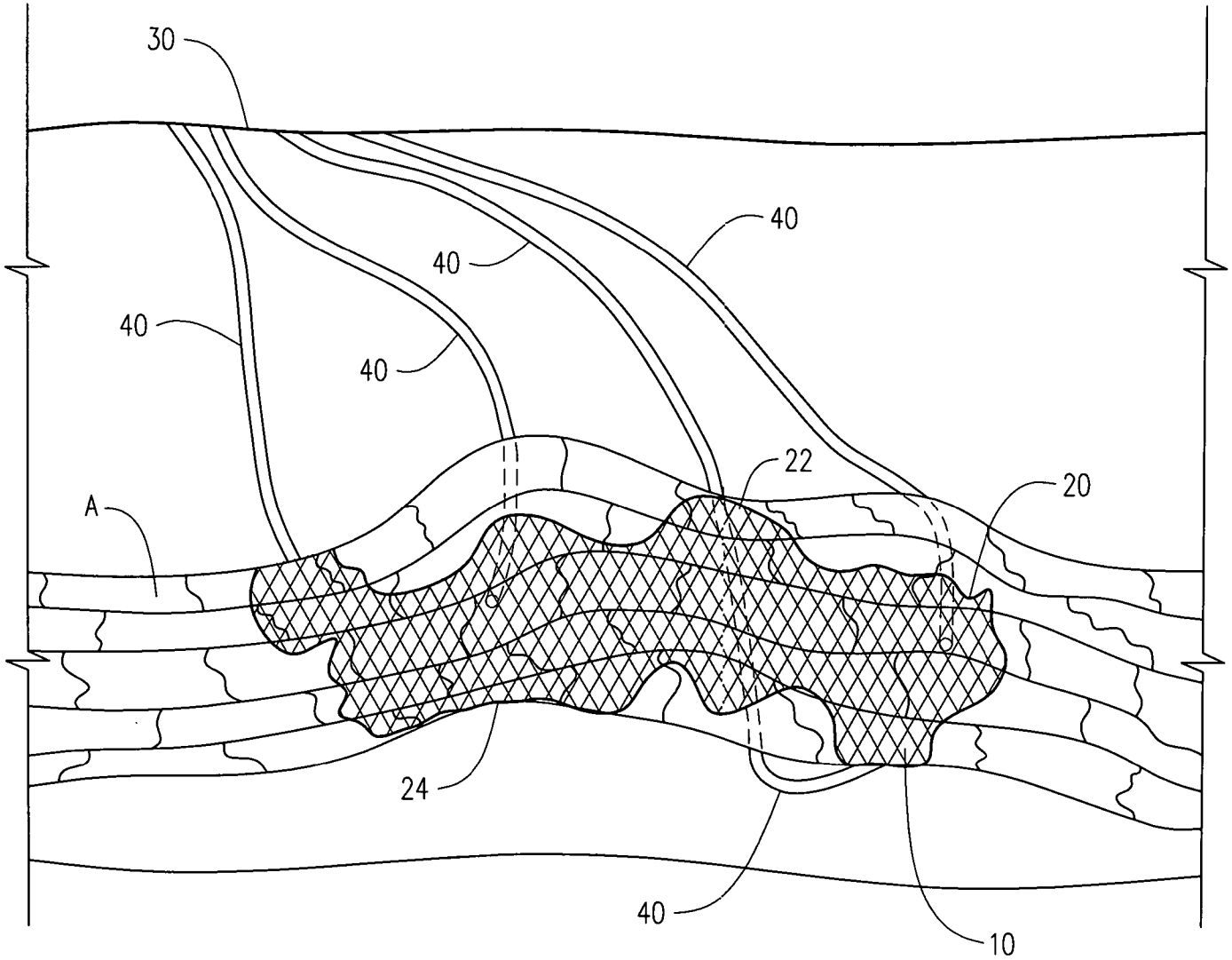
FIG. 3 is an illustration showing a plurality of bore holes entering the coal seam fire.
Figure 4:
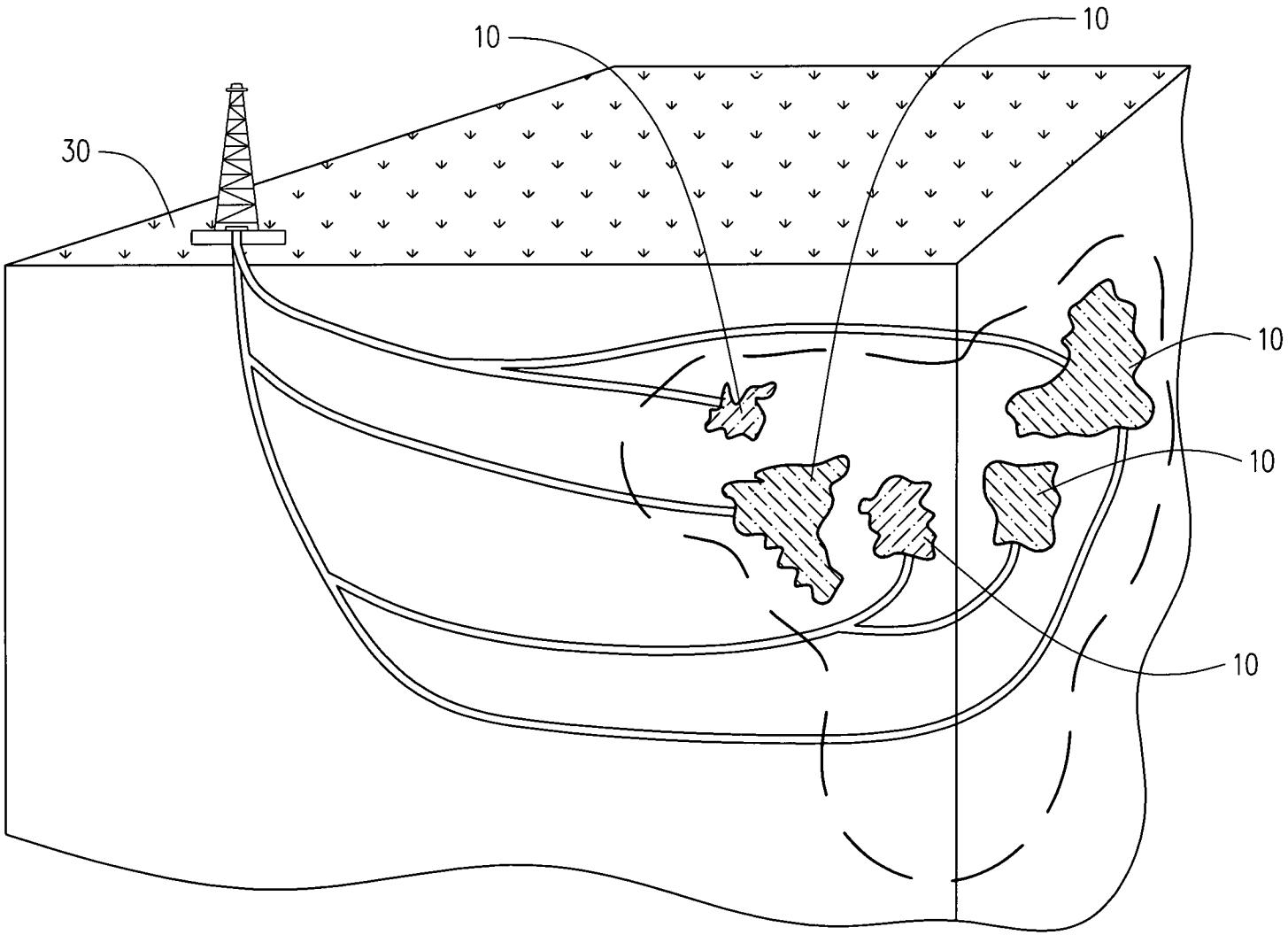
FIG. 4 is an illustration of a boring pathway using a directional boring apparatus.
Figure 5:
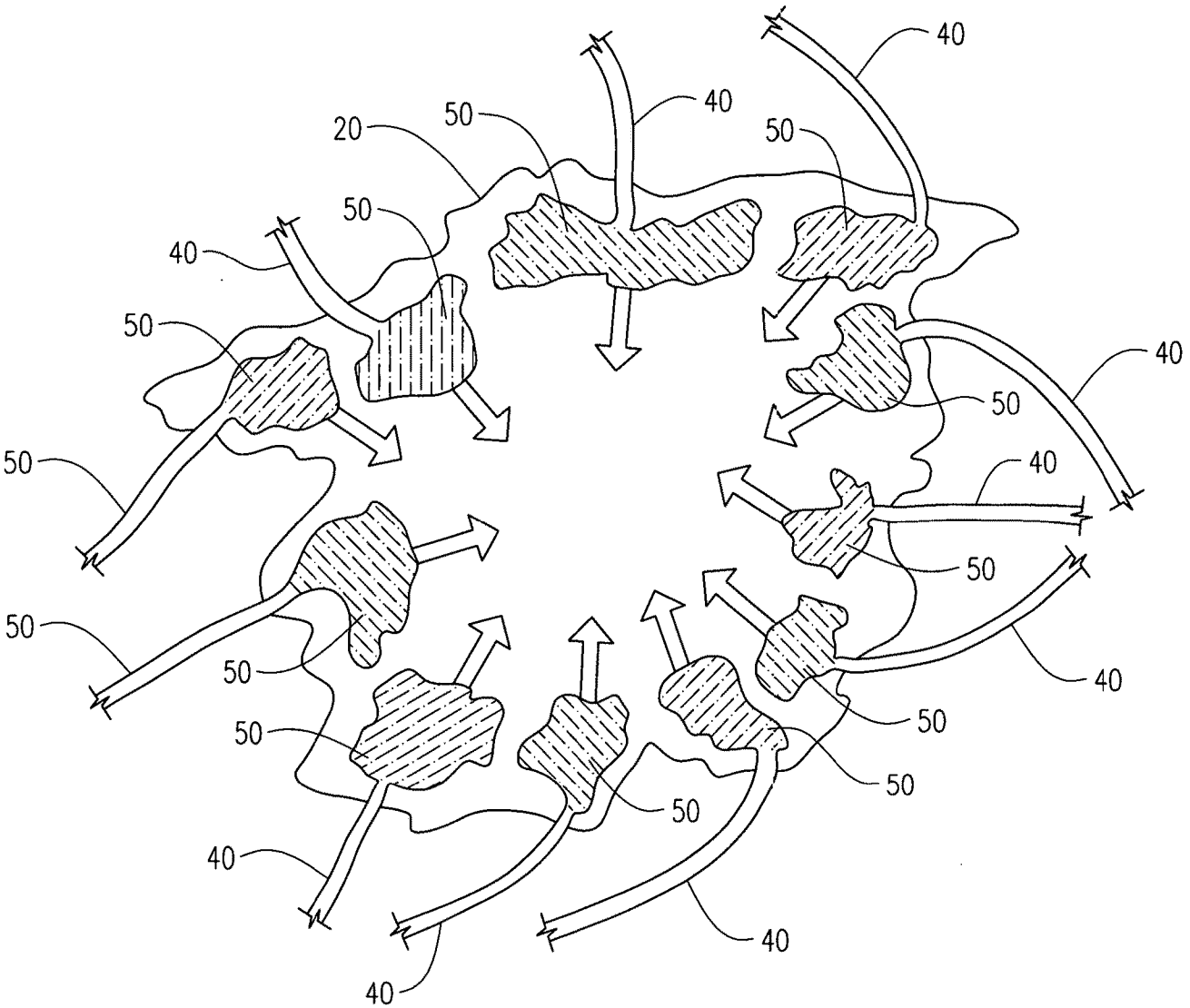
FIG. 5 is a representative view of the coal seam fire being extinguished from its perimeter into a central core.
Figure 5:
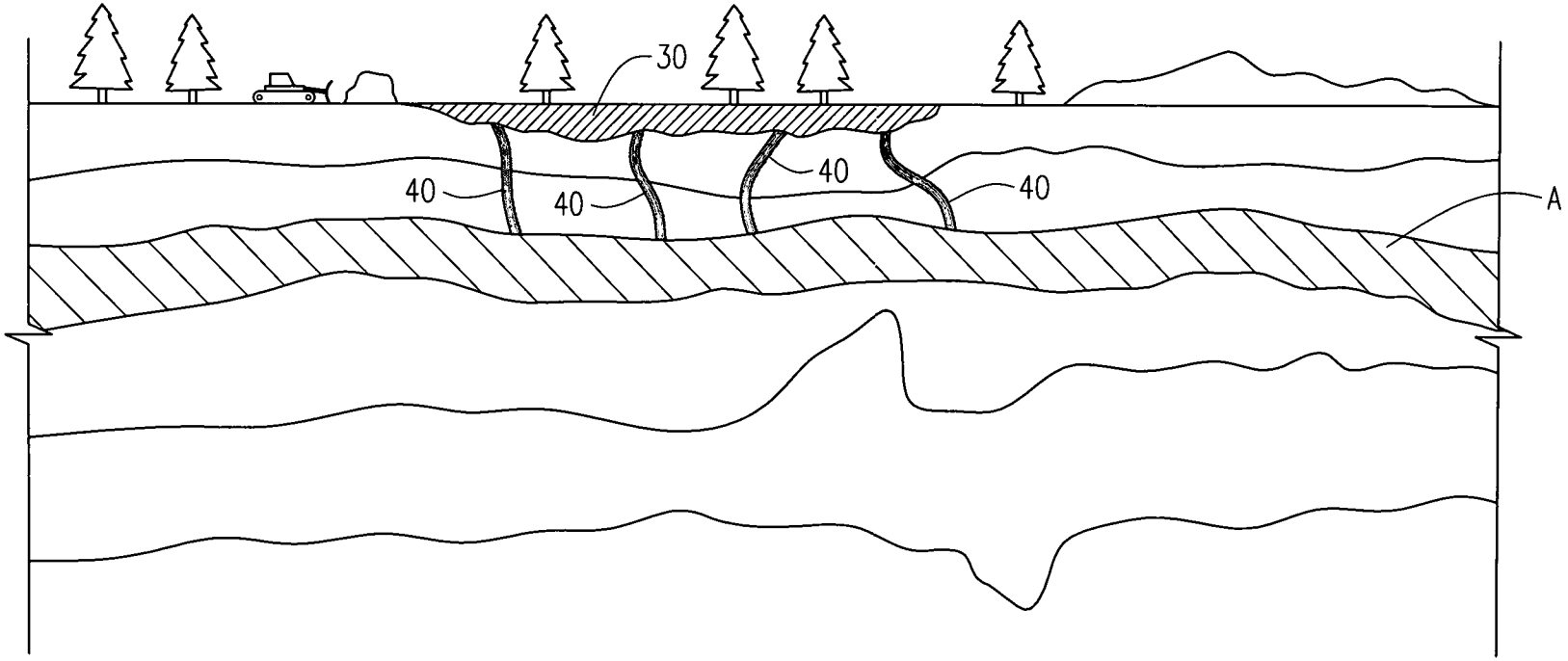

A method and process for the suppression and extinguishment of a coal seam fire 10 to minimize surface interruption and damage to the surface above the coal seam fire 10, the method and process a indicated in FIGS. 1-6 of the drawings including the steps of locating the nature and extent of the coal seam fire 10 which is active using topical and diagnostic testing, including initial aerial observation of thermal deviation and geological indicators consistent with underground fire, pinpointing the outer perimeter 20 (a/k/a coal seam fire area 20), upper boundary 22 (a/k/a geological ceiling 22) and lower boundary 24 (a/k/a geological floor 24) of the active coal seam fire area, FIG. 2, determining the minimal number of least environmentally detrimental surface locations 30 for the application of directional boring equipment to a plurality of fire perimeter 20 points from as few surface locations 30 to conduct drilling, suppression, extinguishment and restoration procedures, FIG. 3, drilling a plurality of directional bore holes 40 from the determined least environmentally detrimental surface locations 30 completely surrounding the active coal seam fire 10 providing multiple passages from the surface locations 30 into the outer perimeter 20, geological ceiling 22 and geological floor 24 of the coal seam fire 10, FIGS. 3-4, applying large quantities of a foam mixture 50 of soap, water and an inert gas through forcible injection into each of the plurality of bore holes 40 contemporaneously to wet and cool the fire into the coal seam fire perimeter 20, ceiling 22 and floor 24 to ultimately into the central core of the coal seam A from the outside of the fire to its core, FIG. 5, the foam forcibly displacing the combustion air source from the coal seam fire 10 until such time as the entire coal seam A has been saturated with the foam mixture 50 to extinguish the coal seam fire 10, confirming the extinction of the coal seam fire 10 and the absence of any reignition of the coal seam fire 10, filling the bore holes 40 and sealing them to eliminate any intrusion of new combustion air to reduce the chance of subsequent reignition, FIG. 6, and restoring the surface locations 30 to a pre-suppression condition, or as close as possible to the condition of the surface prior to the method application, FIGS. 1 and 6.

It is contemplated that since coal seams A are known to vary in several factors, that other additional steps may be required to gain access to the coal seam A and for the preparation of the coal seam A to maximize the extinguishment method. There are several different types of coal which vary in combustion character, ignition temperature, density and layering thickness. "Coal" originates from peat, or plant matter, and is classified and ranked from lignite, which is a soft, immature brown coal, sub-bituminous, which is darker and harder than the lignite, bituminous, which is the next phase and is the state at which the coal becomes hard and black, and the final stage anthracite, which is black and shiny and very hard. It is this final state that is most desired for use in modern industry as it is the rank of coal having the most potential energy. Because each coal seam A is formed by layers of these differently ranked coals, as the coal matures, the layers become more difficult to separate and likely more densely compacted. It is also recognized that burning coal produces ash, which can cool and compact to a hardness more dense than the coal itself.

In the more compact coal seams A, especially those which have been on fire for longer periods, it may be necessary to introduce steps to include the destabilization of the coal seam substrate layers within the hot coal seam fire 10 prior to the injection of the soap, water and inert gas foam mixture 50 using pressurized expansion injection to open the coal seam A to allow for a less impeded injection of the foam mixture 50 throughout the coal seam A. This may include pressurized steam or introduction of some type of least environmentally detrimental or non-toxic chemicals to separate the substrate layers and dissolve minerals within the coal seam layers. Further, where the separated layers appear to be potentially destabilized during injection of the foam mixture 50, it may also be necessary to introduce a granular material, including sand or other know porous granular material into the newly formed and expanded seams to maintain the coal seam layer separation, allowing the foam mixture 50 to penetrate the coal seam A and perpetuate flow throughout the coal seam A for complete saturation.

Coal seams A may vary in depth from a few feet below the surface to several hundred feet below the surface—even within a common and contiguous coal seam A, justifying the use of directional and horizontal boring techniques. As previously mentioned, using the directional boring technique, the number of surface locations 30 are drastically reduced and each bore is cleaned to allow for the unimpeded flow of the foam mixture 50 into the coal seam A from numerous locations contemporaneously from the top ceiling 22, the floor 24 of the coal seam A and surrounding the entire perimeter 20. The inert gas included in the soap, water and inert gas foam mixture 50 is preferably a nitrogen gas which has been demonstrated to produce no toxic gas emission when used in the suppression of an underground fire and displace oxygen from the fire source, starving the fire of its fuel source for continued combustion. Filling the bore holes 40, a cement slurry, or a dense slurry mixture of the materials removed during the boring process, is pumped into each bore hole into the extinguished coal seam A for the permanent sealing of the formation for stability purposes and to eliminate combustion air back into the coals seam which could potentially lead to reignition.

Although the embodiments of the invention have been described and shown above, it will be appreciated by those skilled in the art that numerous modifications may be made therein without departing from the scope of the invention as herein described.

I claim:

1. A method for suppression of a coal seam fire consisting of the steps of:

locating said coal seam fire with testing, including aerial observation with thermal deviation and observed geological indicators associated with underground thermal issues and said coal seam fire;

pinpointing and identifying the coal seam fire, including a geological ceiling and a geological floor of said coal seam fire;

determining a number of surface locations for application of directional boring equipment to a plurality of fire perimeter points from said number of surface locations to conduct directional boring;

drilling a plurality of directional bore holes from said number of surface locations to completely surround said active coal seam fire providing said plurality of directional bore holes from said surface locations into said plurality of fire perimeter points, an upper boundary and a lower boundary of said coal seam fire;

applying by forcible injection a quantity of a foam mixture comprising soap, water and an inert gas into each of said plurality of directional bore holes contemporaneously to wet and cool said fire within said coal seam fire into a central core of said coal seam fire from said plurality of fire perimeter points to said central core, forcible displacing a combustion aft source from said coal seam fire until such time said entire coal seam has been saturated with said foam mixture to extinguish said coal seam fire;

confirming extinction of said coal seam fire and any reignition of said coal seam fire;

filling said plurality of bore holes with cement or a slurry of materials removed during said directional boring to seal said plurality of bore holes to eliminate any intrusion of combustion air into said plurality of bore holes to prevent subsequent reignition of any-remaining said coal seam fire; and restoring said minimal number of said surface locations to a pre-suppression condition prior to application of said method of suppression.

2. A method for suppression of a coal seam fire consisting of steps of:

locating the coal seam fire with testing, including aerial observation with thermal deviation and observed geological indicators associated with underground thermal issues and said coal seam fire;

pinpointing and identifying the coal seam fire, including a geological ceiling and a geological floor of said coal seam fire;

determining a number of surface locations for application of directional boring equipment to a plurality of fire perimeter points from said number of surface locations to conduct directional boring;

drilling a plurality of directional bore holes from said number of surface locations to completely surround said active coal seam fire providing said plurality of directional bore holes from said number of surface locations into said plurality of fire perimeter points, an upper boundary and a lower boundary of said coal seam fire;

applying by forcible injection a quantity of a foam mixture comprising soap, water and an inert gas into each of said plurality of directional bore holes contemporaneously to wet and cool said fire within said coal seam fire into a central core of said coal seam from said plurality of fire perimeter points to said central core, forcible displacing a combustion air source from said coal seam fire until such time said entire coal seam has been saturated with said foam mixture to extinguish said coal seam fire;

allow for lessened impedance of said foam mixture into said coal seam, said pressurized expansion injection using pressurized steam or chemicals to separate substrate layers within said coal seam and dissolve minerals within said coal seam;

confirming extinction of said coal seam fire and any reignition of said coal seam fire;

filling said plurality of bore holes with cement or a slurry of materials removed during said directional boring to seal said plurality of bore holes to eliminate any intrusion of combustion aft into said plurality of bore holes to prevent subsequent reignition of any remaining said coal seam fire; and restoring said number of said surface locations to a pre-suppression condition prior to application of said method of suppression.

3. A method for suppression of a coal seam fire consisting of steps of:

locating the coal seam fire with testing, including aerial observation with thermal deviation and observed geological indicators associated with underground thermal issues and said coal seam fire;

pinpointing and identifying the coal seam fire, including a geological ceiling and a geological floor of said coal seam fire;

determining a number of surface locations for application of directional boring equipment to a plurality of fire perimeter points from said number of surface locations to conduct directional boring;

drilling a plurality of directional bore holes from said number of surface locations to completely surround said active coal seam fire providing said plurality of directional bore holes from said number of surface locations into said plurality of fire perimeter points, an upper boundary and a lower boundary of said coal seam fire;

destabilizing a coal seam at said coal seam fire prior to a forcible injection of a foam mixture using pressurized expansion injection to open and expand said coal seam to avow for lessened impedance of said foam mixture into said coal seam, said pressurized expansion injection using pressurized steam or chemicals to separate substrate layers within said coal seam and dissolve minerals within said coal seam; and introducing a granular material, including sand, fine gravel, or silica into a newly formed open and expanded said coal seam to maintain a coal seam layer separation, allowing said foam mixture to penetrate said coal seam and perpetuate flow throughout said coal seam for enhanced saturation;

applying by the forcible injection a quantity of said foam mixture comprising soap, water and an inert gas into each of said plurality of directional bore holes contemporaneously to wet and cool said fire within said coal seam fire into a central core of said coal seam from said plurality of fire perimeter points to said central core, forcible displacing a combustion aft source from said coal seam fire until such time said entire coal seam has been saturated with said foam mixture to extinguish said coal seam fire;

confirming extinction of said coal seam fire and any reignition of said coal seam fire;

filling said plurality of directional bore holes with cement or a slurry of materials removed during said directional boring to seal said plurality of directional bore holes to eliminate any intrusion of combustion aft into said plurality of bore holes to prevent subsequent reignition of any remaining said coal seam fire; and restoring said number of said surface locations to a pre-suppression condition prior to application of said method of suppression.

* * * * *